US007828907B2

(12) United States Patent
Miralles et al.

(10) Patent No.: US 7,828,907 B2
(45) Date of Patent: Nov. 9, 2010

(54) DETERGENT COMPONENT FOR PREVENTING PRECIPITATION OF WATER HARDNESS AND PROVIDING SOIL REMOVAL PROPERTIES

(75) Inventors: Altony Miralles, Woodbury, MN (US); Michael E. Besse, Golden Valley, MN (US)

(73) Assignee: Ecolab Inc., Eagan, MN (US)

( * ) Notice: Subject to any disclaimer, the term of this patent is extended or adjusted under 35 U.S.C. 154(b) by 546 days.

(21) Appl. No.: 11/801,373

(22) Filed: May 9, 2007

(65) Prior Publication Data

US 2008/0276973 A1 Nov. 13, 2008

(51) Int. Cl.
*B08B 3/04* (2006.01)

(52) U.S. Cl. ..... 134/26; 134/25.2; 134/27; 134/28; 134/29; 134/36; 134/40; 134/42; 510/405; 510/467; 510/479; 510/480; 510/512; 8/147; 8/158

(58) Field of Classification Search ..... 134/25.2, 134/26, 27, 28, 29, 36, 40, 42; 510/405, 510/479, 480, 467, 512; 8/147, 158
See application file for complete search history.

(56) References Cited

U.S. PATENT DOCUMENTS

| | | | | |
|---|---|---|---|---|
| 3,048,548 | A | 8/1962 | Martin et al. | |
| 3,334,147 | A | 8/1967 | Brunelle et al. | |
| 3,442,242 | A | 5/1969 | Laskey et al. | |
| 4,255,309 | A | 3/1981 | Klaessig et al. | |
| 4,294,711 | A | 10/1981 | Hardy et al. | |
| 4,321,165 | A | 3/1982 | Smith et al. | |
| 4,333,862 | A | 6/1982 | Smith et al. | |
| 4,379,061 | A | 4/1983 | Rabitsch et al. | |
| 4,618,914 | A | 10/1986 | Sato et al. | |
| 4,664,835 | A | 5/1987 | Grollier et al. | |
| 4,786,433 | A | 11/1988 | Marquardt et al. | |
| 4,818,424 | A | 4/1989 | Evans et al. | |
| 4,820,441 | A | 4/1989 | Evans et al. | |
| 4,830,773 | A | 5/1989 | Olson | |
| 4,882,074 | A | 11/1989 | Kenyon et al. | |
| 4,923,636 | A | 5/1990 | Blackburn et al. | |
| 5,188,752 | A | 2/1993 | Prencipe et al. | |
| 5,510,048 | A * | 4/1996 | Durbut et al. | 510/223 |
| 5,545,344 | A | 8/1996 | Durbut et al. | |
| 5,905,065 | A | 5/1999 | Scialla et al. | |
| 6,255,274 | B1 | 7/2001 | Becherer et al. | |
| 6,528,471 | B1 | 3/2003 | Del Duca et al. | |
| 7,632,793 | B2 * | 12/2009 | Lang | 510/109 |
| 2004/0097394 | A1 | 5/2004 | Burrows et al. | |
| 2008/0274930 | A1 * | 11/2008 | Smith et al. | 510/221 |
| 2008/0274940 | A1 * | 11/2008 | Tjelta et al. | 510/445 |
| 2008/0276967 | A1 * | 11/2008 | Smith et al. | 134/18 |
| 2008/0276973 | A1 * | 11/2008 | Miralles et al. | 134/34 |
| 2008/0300160 | A1 * | 12/2008 | Smith et al. | 510/220 |

FOREIGN PATENT DOCUMENTS

| | | |
|---|---|---|
| FR | 1600927 | 8/1970 |
| FR | 20209123 | 10/1970 |

OTHER PUBLICATIONS

Performance & Industrial Chemicals—Reference Guide, Brochure, 2005, 45 pages, International Specialty Products, Designed & Printed in USA.
Polymers for Oral Care—Product & Applications Guide, Brochure, 2003, 19 pages, International Specialty Products, Designed & Printed in USA.
Toothpaste & Mouthwash Tartar Control, Article, 2007, 2 pages, International Specialty Products.
Gantrez® Polymers, Article, 2007, 3 pages, International Specialty Products.
International Search Report and Written Opinion of international application number PCT/IB2008/050827, mailed Sep. 30, 2008, 11 pp.

* cited by examiner

*Primary Examiner*—Sharidan Carrillo
(74) *Attorney, Agent, or Firm*—Faegre & Benson LLP

(57) ABSTRACT

A cleaning composition for removing soils includes an alkyl vinyl ether-maleic acid copolymer and at least one component selected from the group consisting of sodium carbonate and sodium hydroxide. The composition contains less than about 10% by weight of at least one component selected from the group consisting of phosphorous-containing components and aminocarboxylates.

7 Claims, No Drawings

DETERGENT COMPONENT FOR PREVENTING PRECIPITATION OF WATER HARDNESS AND PROVIDING SOIL REMOVAL PROPERTIES

BACKGROUND

Conventional detergents used in the warewashing and laundry industries include alkaline detergents. Alkaline detergents, particularly those intended for institutional and commercial use, generally contain phosphates and aminocarboxylates. Phosphates and aminocarboxylates are multifunctional components commonly used in detergents to reduce water hardness as well as increase detergency, antiredeposition, and crystal modification. Detergency is defined as the ability to wet, emulsify, suspend, penetrate, and dispense soils.

In particular, polyphosphates such as sodium tripolyphosphate and aminocarboxylates such as nitrilotriacetic acid (NTA) or ethylenediaminetetraacetic acid and their salts are used in detergents because of their ability to prevent calcium carbonate precipitation and their ability to disperse and suspend soils. If calcium carbonates are allowed to precipitate, the crystals may attach to the surface of the surface being cleaned and may cause undesirable effects. For example, calcium carbonate precipitation on the surface of ware can negatively impact the aesthetic appearance of the ware and give the ware an unclean look. In the laundering area, if calcium carbonate precipitates and attaches onto the surface of fabric, the crystals may leave the fabric feeling hard and rough to the touch. The ability of sodium tripolyphosphate and NTA to disperse and suspend soils facilitates the detergency of the solution by preventing the soils from redepositing into the wash solution or wash water. In addition, sodium tripolyphosphate and NTA also have the ability to increase and buffer the pH of the detergent. If the alkalinity of the detergent is too high, the surface of the fabric washed with the detergent may have an irritant effect on skin, which has a relatively neutral pH.

However, while effective, both phosphates and aminocarboxylates are subject to government regulations due to environmental and health concerns. Phosphates have a detrimental impact when released into the environment, and aminocarboxylates are believed to be carcinogenic. There is, therefore, a need in the art for an environmentally friendly multifunctional component that can replace the properties of phosphorous compounds such as phosphates, phosphonates, phosphites, and acrylic phosphinate polymers, as well as aminocarboxylates.

SUMMARY

A cleaning composition for removing soils includes an alkyl vinyl ether-maleic acid copolymer and at least one component selected from the group consisting of sodium carbonate and sodium hydroxide. The composition contains less than about 10% by weight of at least one component selected from the group consisting of phosphorous-containing components and aminocarboxylates.

DETAILED DESCRIPTION

The composition of the present invention may be employed in any of a wide variety of situations in which phosphorous and/or aminocarboxylates are currently being used. For example, the composition may be used to replace sodium tripolyphosphate and nitrilotriacetate in currently available laundry detergents. The composition is especially useful in cleaning applications where it is desired to reduce water hardness as well as increase detergency, antiredeposition, and crystal modification. Such applications include, but are not limited to: presoaks, laundry and textile cleaning and destaining, carpet cleaning and destaining, machine and manual warewashing, vehicle cleaning and care applications, surface cleaning and destaining, kitchen and bath cleaning and destaining, floor cleaning and destaining, cleaning in place operations, general purpose cleaning and destaining, and industrial or household cleaners.

The present invention is a cleaning composition that exhibits detergency, soil suspension, antiredeposition, and crystal modification properties typically attributed to phosphorous and aminocarboxylates in common laundry detergents. Unlike most cleaning compositions currently known in the art, the cleaning composition does not have to include phosphorous or aminocarboxylates to be effective. The cleaning composition may be used in solid form or in liquid form. In solid form, the composition may take forms including, but not limited to: a cast, extruded, molded or formed solid pellet, block, tablet, powder, granule, flake, and the like, or the formed solid or aggregate can thereafter be ground or formed into a powder, granule, flake, and the like.

The cleaning composition generally includes an alkyl vinyl ether-maleic acid copolymer and at least one component selected from the group consisting of: sodium carbonate (soda ash or dense ash) and sodium hydroxide (caustic soda). Examples of suitable alkyl vinyl ether-maleic acid copolymers include alkyl vinyl ether-maleic acid copolymers having between one carbon atom and six carbon atoms. An example of a particularly suitable alkyl vinyl ether-maleic acid copolymer is methyl vinyl ether-maleic acid copolymer. Examples of suitable commercially available methyl vinyl ether-maleic acid copolymers include, but are not limited to: Gantrez S-95 and Gantrez S-96, available from International Specialty Products, Wayne, N.J.; and EVD 65753 and EVD 65754, available from BASF Corporation, Florham Park, N.J. A suitable concentration range of alkyl vinyl ether-maleic acid copolymer and sodium carbonate in the cleaning composition includes between approximately 0.0005% and approximately 10% by weight of methyl ether-maleic acid copolymer and between approximately 1% and approximately 90% by weight of sodium carbonate, sodium hydroxide, or a mixture of sodium carbonate and sodium hydroxide. A particularly suitable concentration range of alkyl vinyl ether-maleic acid copolymer and sodium carbonate in the cleaning composition includes between approximately 0.002% and approximately 4% by weight of alkyl vinyl ether-maleic acid copolymer and between approximately 5% and approximately 70% by weight of sodium carbonate, sodium hydroxide, or a mixture of sodium carbonate and sodium hydroxide. It should be understood that the concentration of alkyl vinyl ether-maleic acid copolymer in the cleaning composition will vary depending on whether the cleaning composition is provided as a concentrate or as a use solution. For example, a suitable concentration range of alkyl vinyl ether-maleic acid copolymer in a concentrate is between approximately 1% and approximately 10% by weight. A suitable concentration range of alkyl vinyl ether-maleic acid copolymer in a use solution is between approximately 0.0005% and approximately 0.05% by weight.

The alkyl vinyl ether-maleic acid copolymer may act as a crystal modifier and may interact synergistically with other components, such as surfactants, present in the composition. Without being bound by theory, it is believed that the alkyl vinyl ether-maleic acid copolymer acts as a crystal modifier to prevent the precipitation of calcium carbonate in the cleaning composition. As a crystal modifier, the alkyl vinyl ether-maleic acid copolymer modifies the surface of the crystal to prevent crystal growth by binding to the calcium ions on the crystal surface.

Without being bound by theory, it is believed that the synergistic properties of the alkyl vinyl ether-maleic acid copolymer may be attributed to the hydrophobicity of the backbone of the copolymer and the hydrophilicity of the carboxylate groups from the maleic moiety of the copolymer. The hydrophobic nature of the alkyl vinyl ether-maleic acid copolymer allows the copolymer to penetrate the soils attached on the surface to be cleaned (which are also hydrophobic) and aids in lifting the soils from the surface. In addition, the carboxylate groups (maleic acid) of the alkyl vinyl ether-maleic acid copolymer can bind metals that are free or are part of a small insoluble crystal (inorganic soil) and aid in loosening the hydrophobic part of the soil from the surface to be cleaned.

The cleaning composition also includes an alkalinity source comprising sodium carbonate, sodium hydroxide, or a mixture of sodium carbonate and sodium hydroxide. The alkalinity source controls the pH of the resulting solution when water is added to the cleaning composition to form a use solution. The pH of the cleaning composition must be maintained in the alkaline range in order to provide sufficient detergency properties. In an exemplary embodiment, the pH of the cleaning composition is between approximately 9 and approximately 12. If the pH of the cleaning composition is too low, for example, below approximately 9, the cleaning composition may not provide adequate detergency properties. If the pH of the cleaning composition is too high, for example, above approximately 12, the cleaning composition may become caustic and begin to attack the surface to be cleaned.

The cleaning composition is also substantially free of phosphorous and aminocarboxylates. Substantially phosphorous-free refers to a composition to which phosphorous-containing compounds are not added. Substantially aminocarboxylate-free refers to a composition to which aminocarboxylate-containing compounds are not added. In an exemplary embodiment, the cleaning composition includes less than approximately 10% phosphates, phosphonates, and phosphites, or mixtures thereof by weight and less than approximately 10% aminocarboxylates by weight. Preferably, the cleaning composition includes less than approximately 5% phosphates, phosphonates, and phosphites by weight and less than approximately 5% aminocarboxylates by weight. More preferably, the cleaning composition includes less than approximately 1% phosphates, phosphonates, and phosphites by weight and less than approximately 1% aminocarboxylates by weight. Most preferably, the cleaning composition includes less than approximately 0.1% phosphates, phosphonates, and phosphites by weight and less than approximately 0.1% aminocarboxylates by weight.

As previously mentioned, the cleaning composition may be diluted to form a use solution. The typical dilution factor is between approximately 1 and approximately 570 but will depend on factors including, but not limited to: water hardness and the amount of soil to be removed. When the cleaning composition is diluted to a use solution, the methyl ether-maleic acid copolymer is effective at concentrations of less than approximately 200 parts per million (ppm). In an exemplary embodiment, the alkyl vinyl ether-maleic acid copolymer is effective at use concentrations of between approximately 5 ppm and approximately 200 ppm. In another exemplary embodiment, the alkyl vinyl ether-maleic acid copolymer is effective at use concentrations of between approximately 10 ppm and approximately 50 ppm. When diluted to a use solution, the cleaning composition includes phosphorous-containing component and aminocarboxylate concentration of less than approximately 100 ppm, preferably less than approximately 10 ppm, and most preferably less than approximately 1 ppm.

Additional Functional Materials

The cleaning composition may contain other functional materials that provide desired properties and functionalities to the cleaning composition. For the purpose of this application, the term "functional materials" include a material that when dispersed or dissolved in a use and/or concentrate solution, such as an aqueous solution, provides a beneficial property in a particular use. Examples of such functional materials include, but are not limited to: alkaline sources; organic detergents, surfactants or cleaning agents; rinse aids; bleaching agents; sanitizers/anti-microbial agents; activators; detergent builders or fillers; defoaming agents, anti-redeposition agents; optical brighteners; dyes/odorants; secondary hardening agents/solubility modifiers; pesticides for pest control applications; or the like, or a broad variety of other functional materials, depending upon the desired characteristics and/or functionality of the composition. Some more particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Inorganic Detergents or Alkaline Sources

The cleaning composition may include effective amounts of one or more alkaline sources to, for example, enhance cleaning of a substrate and improve soil removal performance of the composition. An alkali metal carbonate such as lithium, sodium, or potassium carbonate, bicarbonate, sesquicarbonate, and mixtures thereof can be used. Suitable alkali metal hydroxides include, but are not limited to: lithium, sodium or potassium hydroxide. An alkali metal hydroxide may be added to the composition in the form of solid beads, dissolved in an aqueous solution, or a combination thereof. Other examples of useful alkaline sources include an alkaly metal silicate such as lithium, sodium or potassium silicate (for example, with a M2O:SiO2 ratio of about 1:2.4 to about 5:1, M representing an alkali metal) or metasilicate; a metal borate such as sodium or potassium borate, and the like; alkanolamines and amines; and other like alkaline sources.

Organic Detergents, Surfactants or Cleaning Agents

The cleaning composition can optionally include at least one cleaning agent such as a surfactant or surfactant system. A variety of surfactants may be used, including anionic, nonionic, cationic, and zwitterionic surfactants. For a discussion of surfactants, see Kirk-Othmer, Encyclopedia of Chemical Technology, Third Edition, volume 8, pages 900-912, which is incorporated herein by reference.

Examples of suitable anionic surfactants useful in cleaning compositions, include, but are not limited to: carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like. Some particularly suitable anionic surfactants include, but are not limited to: sodium alkylarylsulfonate, alpha-olefinsulfonate, and fatty alcohol sulfates.

Nonionic surfactants useful in cleaning compositions include those having a polyalkylene oxide polymer as a portion of the surfactant molecule. Examples of suitable nonionic surfactants include, but are not limited to: chlorine-, benzyl-, methyl-, ethyl-, propyl, butyl-and alkyl-capped polyethylene glycol ethers of fatty alcohols; polyalkylene oxide free nonionics such as alkyl polyglucosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer. Examples of suitable commercially available nonionic surfactants include, but are not limited to: PLURONIC, available from BASF Corporation, Florham Park, N.J. and ABIL B8852, available from Goldschmidt Chemical Corporation, Hopewell, Va.

Cationic surfactants useful for inclusion in the cleaning composition for sanitizing or fabric softening include, but are not limited to: amines such as primary, secondary and tertiary amines with C18 alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl(C12-C18)dimethylbenzyl ammonium chloride, n-tetradecyldimethylbenzylammonium chloride monohydrate, and naphthalene-substituted quaternary ammonium chlorides such as dimethyl-1-naphthylmethylammonium chloride. For a more extensive list of surfactants, see McCutcheon's Emulsifiers and Detergents, which is incorporated herein by reference.

Rinse Aids

The cleaning composition can optionally include a rinse aid composition, for example a rinse aid formulation containing a wetting or sheeting agent combined with other optional ingredients in a solid composition made using the binding agent. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: polyether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule.

Bleaching Agents

The cleaning composition can optionally include a bleaching agent for lightening or whitening a substrate, and can include bleaching compounds capable of liberating an active halogen species, such as $Cl_2$, $Br_2$, —OCl— and/or —OBr—, or the like, under conditions typically encountered during the cleansing process. Examples of suitable bleaching agents include, but are not limited to: chlorine-containing compounds such as chlorine, a hypochlorite or chloramines. Examples of suitable halogen-releasing compounds include, but are not limited to: alkali metal dichloroisocyanurates, alkali metal hypochlorites, monochloramine, and dichloroamine. Encapsulated chlorine sources may also be used to enhance the stability of the chlorine source in the composition (see, for example, U.S. Pat. Nos. 4,618,914 and 4,830,773, the disclosures of which are incorporated by reference herein). The bleaching agent may also include an agent containing or acting as a source of active oxygen. The active oxygen compound acts to provide a source of active oxygen and may release active oxygen in aqueous solutions. An active oxygen compound can be inorganic, organic or a mixture thereof. Examples of suitable active oxygen compounds include, but are not limited to: peroxygen compounds, peroxygen compound adducts, hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine.

Sanitizers/Anti-Microbial Agents

The cleaning composition can optionally include a sanitizing agent (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly (vinylpyrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action.

Activators

In some embodiments, the antimicrobial activity or bleaching activity of the composition can be enhanced by the addition of a material which, when the cleaning composition is placed in use, reacts with the active oxygen to form an activated component. For example, in some embodiments, a peracid or a peracid salt is formed. For example, in some embodiments, tetraacetylethylene diamine can be included within the cleaning composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. In some embodiments, an activator for an active oxygen compound combines with the active oxygen to form an antimicrobial agent.

In some embodiments, the cleaning composition is in the form of a solid block, and an activator material for the active oxygen is coupled to the solid block. The activator can be coupled to the solid block by any of a variety of methods for coupling one solid cleaning composition to another. For example, the activator can be in the form of a solid that is bound, affixed, glued or otherwise adhered to the solid block. Alternatively, the solid activator can be formed around and encasing the block. By way of further example, the solid activator can be coupled to the solid block by the container or package for the cleaning composition, such as by a plastic or shrink wrap or film.

Detergent Builders or Fillers

The cleaning composition can optionally include a minor but effective amount of one or more of a detergent filler which does not necessarily perform as a cleaning agent per se, but may cooperate with a cleaning agent to enhance the overall cleaning capacity of the composition. Examples of suitable fillers include, but are not limited to: sodium sulfate, sodium chloride, starch, sugars, and C1-C10 alkylene glycols such as propylene glycol.

pH Buffering Agents

Additionally, the cleaning composition can be formulated such that during use in aqueous operations, for example in aqueous cleaning operations, the wash water will have a desired pH. For example, compositions designed for use in providing a presoak composition may be formulated such that during use in aqueous cleaning operations the wash water will have a pH in the range of about 6.5 to about 11, and in some embodiments, in the range of about 7.5 to about 10.5. Liquid product formulations in some embodiments have a (10% dilution) pH in the range of about 7.5 to about 10.0, and in some embodiments, in the range of about 7.5 to about 9.0.

For example, a souring agent may be added to the cleaning composition such that the pH of the textile approximately matches the proper processing pH. The souring agent is a mild acid used to neutralize residual alkalines and reduce the pH of the textile such that when the garments come into contact with human skin, the textile does not irritate the skin. Examples of suitable souring agents include, but are not limited to: phosphoric acid, formic acid, acetic acid, hydrofluorosilicic acid, saturated fatty acids, dicarboxylic acids, tricarboxylic acids, and any combination thereof. Examples of saturated fatty acids include, but are not limited to: those having 10 or more carbon atoms such as palmitic acid, stearic acid, and arachidic acid (C20). Examples of dicarboxylic acids include, but are not limited to: oxalic acid, tartaric acid, glutaric acid, succinic acid, adipic acid, and sulfamic acid. Examples of tricarboxylic acids include, but are not limited to: citric acid and tricarballylic acids. Examples of suitable commercially available souring agents include, but are not limited to: TurboLizer, Injection Sour, TurboPlex, AdvaCare 120 Sour, AdvaCare 120 Sanitizing Sour, CarboBrite, and Econo Sour, all available from Ecolab Inc., St. Paul, Minn.

Fabric Relaxants

A fabric relaxant may be added to the cleaning composition to increase the smoothness appearance of the surface of the textile.

Fabric Softeners

A fabric softener may also be added to the cleaning composition to soften the feel of the surface of the textile. An example of a suitable commercially available fabric softener includes, but is not limited to, TurboFresh, available from Ecolab Inc., St. Paul, Minn.

Soil Releasing Agents

The cleaning composition can include soil releasing agents that can be provided for coating the fibers of textiles to reduce the tendency of soils to attach to the fibers. Examples of suitable commercially available soil releasing agents include, but are not limited to: polymers such as Repel-O-Tex SRP6 and Repel-O-Tex PF594, available from Rhodia, Cranbury, N.J.; TexaCare 100 and TexaCare 240, available from Clariant Corporation, Charlotte, N.C.; and Sokalan HP22, available from BASF Corporation, Florham Park, N.J.

Defoaming Agents

The cleaning composition can optionally include a minor but effective amount of a defoaming agent for reducing the stability of foam. Examples of suitable defoaming agents include, but are not limited to: silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and 3,442,242 to Rue et al., the disclosures of which are incorporated by reference herein.

Anti-Redeposition Agents

The cleaning composition can optionally include an anti-redeposition agent capable of facilitating sustained suspension of soils in a cleaning solution and preventing the removed soils from being redeposited onto the substrate being cleaned. Examples of suitable anti-redeposition agents include, but are not limited to: fatty acid amides, fluorocarbon surfactants, complex phosphate esters, styrene maleic anhydride copolymers, and cellulosic derivatives such as hydroxyethyl cellulose, hydroxypropyl cellulose.

Optical Brighteners

The cleaning composition can optionally include an optical brightener, also referred to as a fluorescent whitening agent or a fluorescent brightening agent, and can provide optical compensation for the yellow cast in fabric substrates.

Fluorescent compounds belonging to the optical brightener family are typically aromatic or aromatic heterocyclic materials often containing a condensed ring system. A feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (naphthalamides, triazines, etc.). The choice of optical brighteners for use in compositions will depend upon a number of factors, such as the type of composition, the nature of other components present in the composition, the temperature of the wash water, the degree of agitation, and the ratio of the material washed to the tub size. The brightener selection is also dependent upon the type of material to be cleaned, e.g., cottons, synthetics, etc. Because most laundry detergent products are used to clean a variety of fabrics, the detergent compositions may contain a mixture of brighteners which are effective for a variety of fabrics. It is of course necessary that the individual components of such a brightener mixture be compatible.

Examples of suitable optical brighteners are commercially available and will be appreciated by those skilled in the art. At least some commercial optical brighteners can be classified into subgroups, including, but are not limited to: derivatives of stilbene, pyrazoline, carboxylic acid, methinecyanines, dibenzothiophene-5,5-dioxide, azoles, 5-and 6-membered-ring heterocycles, and other miscellaneous agents. Examples of particularly suitable optical brightening agents include, but are not limited to: distyryl biphenyl disulfonic acid sodium salt, and cyanuric chloride/diaminostilbene disulfonic acid sodium salt. Examples of suitable commercially available optical brightening agents include, but are not limited to: Tinopal 5 BM-GX, Tinopal CBS-CL, Tinopal CBS-X, and Tinopal AMS-GX, available from Ciba Specialty Chemicals Corporation, Greensboro, N.C. Examples of optical brighteners are also disclosed in "The Production and Application of Fluorescent Brightening Agents", M. Zahradnik, Published by John Wiley & Sons, New York (1982), the disclosure of which is incorporated herein by reference.

Suitable stilbene derivatives include, but are not limited to: derivatives of bis(triazinyl)amino-stilbene, bisacylamino derivatives of stilbene, triazole derivatives of stilbene, oxadiazole derivatives of stilbene, oxazole derivatives of stilbene, and styryl derivatives of stilbene.

Anti-Static Agents

The cleaning composition can include an anti-static agent such as those commonly used in the laundry drying industry to provide anti-static properties. Anti-static agents can generate a percent static reduction of at least about 50% when compared with a textile that is not subjected to treatment. The percent static reduction can be greater than 70% and it can be greater than 80%. An example of an anti-static agent includes, but is not limited to, an agent containing quaternary groups.

Anti-Wrinkling Agents

The cleaning composition can include anti-wrinkling agents to provide anti-wrinkling properties. Examples of anti-wrinkling suitable agents include, but are not limited to: siloxane or silicone containing compounds and quaternary ammonium compounds. Particularly suitable examples of anti-wrinkling agents include, but are not limited to: polydimethylsiloxane diquaternary ammonium, silicone copolyol fatty quaternary ammonium, and polydimethyl siloxane with polyoxyalkylenes. Examples of commercially available anti-wrinkling agents include, but are not limited to: Rewoquat SQ24, available from Degussa/Goldschmidt Chemical Corporation, Hopewell, Va.; Lube SCI-Q, available from Lambert Technologies; and Tinotex CMA, available from Ciba Specialty Chemicals Corporation, Greensboro, N.C.

Odor-Capturing Agents

The cleaning composition can include odor capturing agents. In general, odor capturing agents are believed to function by capturing or enclosing certain molecules that provide an odor. Examples of suitable odor capturing agents include, but are not limited to: cyclodextrins and zinc ricinoleate.

Fiber Protection Agents

The cleaning composition can include fiber protection agents that coat the fibers of the textile to reduce or prevent disintegration and/or degradation of the fibers. An example of a fiber protection agent includes, but is not limited to, cellulosic polymers.

Color Protection Agents

The cleaning composition can include color protection agents for coating the fibers of a textile to reduce the tendency of dyes to escape the textile into water. Examples of suitable color protection agents include, but are not limited to: quaternary ammonium compounds and surfactants. Examples of particularly suitable color protection agents include, but are not limited to: di-(nortallow carboxyethyl) hydroxyethyl methyl ammonium methylsulfate and cationic polymers. Examples of commercially available surfactant color protection agents include, but are not limited to: Varisoft WE 21 CP and Varisoft CCS-1, available from Degussa/Goldschmidt Chemical Corporation, Hopewell, Va.; Tinofix CL from Ciba Specialty Chemicals Corporation, Greensboro, N.C.; Color Care Additive DFC 9, Thiotan TR, Nylofixan P-Liquid, Polymer VRN, Cartaretin F-4, and Cartaretin F-23, available from Clariant Corporation, Charlotte, N.C.; EXP 3973 Polymer, available from Alcoa Inc., Pittsburgh, Pa.; and Coltide, available from Croda International Plc, Edison N.J.

Dyes/Odorants

Various dyes, odorants including perfumes, and other aesthetic enhancing agents may also be included in the cleaning composition. Examples of suitable commercially available dyes include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Examples of suitable fragrances or perfumes include, but are not limited to: terpenoids such as citronellol, aldehydes such as amyl cinnamaldehyde, a jasmine such as C1S-jasmine orjasmal, and vanillin.

UV Protection Agents

The cleaning composition can include a UV protection agent to provide the fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned. An example of a suitable commercially available UV protection agent includes, but is not limited to, Tinosorb FD, available from Ciba Specialty Chemicals Corporation, Greensboro, N.C.

Anti-Pilling Agents

The cleaning composition can include an anti-pilling agent that acts on portions of fibers that stick out or away from the fiber. Anti-pilling agents can be available as enzymes such as cellulase enzymes. Examples of commercially available anti-pilling agents include, but are not limited to: Puradex, available from Genencor International, Pal Alto, Calif.; and Endolase and Carezyme, available from Novozyme, Franklinton, N.C.

Water Repellency Agents

The cleaning composition can include water repellency agents that can be applied to textile to enhance water repellent properties. Examples of suitable water repellenancy agents include, but are not limited to: perfluoroacrylate copolymers, hydrocarbon waxes, and polysiloxanes.

Hardening Agents/Solubility Modifiers

The cleaning composition may include a minor but effective amount of a hardening agent. Examples of suitable hardening agents include, but are not limited to: an amide such stearic monoethanolamide or lauric diethanolamide, an alkylamide, a solid polyethylene glycol, a solid EO/PO block copolymer, starches that have been made water-soluble through an acid or alkaline treatment process, and various inorganics that impart solidifying properties to a heated composition upon cooling. Such compounds may also vary the solubility of the composition in an aqueous medium during use such that the cleaning agent and/or other active ingredients may be dispensed from the solid composition over an extended period of time. Insect Repellants The cleaning composition can include insect repellents such as mosquito repellents. An example of a commercially available insect repellent is DEET. In addition, the aqueous carrier solution can include mildewcides that kill mildew and allergicides that reduce the allergic potential present on certain textiles and/or provide germ proofing properties.

Pest Control Agents

In cleaning compositions intended for use in pest control applications, an effective amount of pest control agents, such as pesticide, attractant, and/or the like may be included. A pesticide is any chemical or biological agent used to kill pests such as, for example, insects and rodents. Examples of pesticides include, but are not limited to: an insecticide or a rodenticide. Examples of rodenticides include, but not are not limited to: difethialone, bromadiolone, brodifacoum, and mixtures thereof.

Other Ingredients

A wide variety of other ingredients useful in providing the particular composition being formulated to include desired properties or functionality may also be included. For example, the cleaning compositions may include other active ingredients, cleaning enzyme, carriers, processing aids, solvents for liquid formulations, or others, and the like.

Method of Use

The cleaning composition may be made using a mixing process. The cleaning composition, including the methyl ether-maleic acid copolymer, alkalinity source (i.e. sodium carbonate, sodium hydroxide, or a mixture of sodium carbonate and sodium hydroxide), and other functional ingredients are mixed for an amount of time sufficient to completely dissolve the components to form a final, homogeneous composition. In an exemplary embodiment, the components of the cleaning composition are mixed for approximately 10 minutes. The cleaning composition may be provided in concentrated form and may need to be diluted to form a use solution subsequent to application. An example of a non-limiting range of dilution is between approximately 10 parts per million alkyl vinyl ether-maleic acid copolymer and approximately 50 parts per million alkyl vinyl ether-maleic acid copolymer.

The cleaning composition is used to prevent calcium precipitation and to remove soils from a surface. For example, the cleaning composition may be used to prevent crystallization of calcium onto the surface of textiles and to remove soil from the surface of textiles. The cleaning composition includes an alkyl vinyl ether-maleic acid copolymer and an alkalinity source which are diluted in water to form a use solution. The use solution is then applied onto the surface for an amount of time sufficient to remove soils from the surface. In an exemplary embodiment, the use solution remains on the surface of at least approximately 4 minutes to effectively remove the soils from the surface. The use solution is then rinsed from the surface.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

The following test method was used to characterize the compositions produced in the examples:

Chelation Test for Alkaline Products

The Calcium, Magnesium, and Hard Water Sequestration by Chelators was determined using the Food and Beverages Test Method 6B (modified) developed by Ecolab, Inc., St. Paul, was used to determine the level of hardness a product can handle at a set concentration. The chelation test used a calcium chloride and magnesium chloride solution, a sodium bicarbonate solution, and a detergent. To prepare the calcium chloride and magnesium chloride solution, 33.45 grams of calcium chloride ($CaCl_2.2H_2O$) and 23.24 g of magnesium chloride ($MgCl_2.6H_2O$) were dissolved in a 1 liter volumetric flask and diluted to volume with deionized water. To prepare the sodium bicarbonate solution, 56.25 grams of sodium bicarbonate ($NaHCO_3.H_2O$) was dissolved in a 1 liter volumetric flask and diluted to volume with deionized water. To prepare the detergent, a motor and pestle was used to grind the detergent to a uniform size. A specified amount of detergent was then placed in 1000 milliliters of deionized water and stirred until dissolved. The concentration was labeled as parts per million of material.

1000 milliliters of deionized water was first added to each beaker. The calcium chloride and magnesium chloride solution, which is a water hardness solution, was then added to each beaker at a concentration of 2 grains per milliliter. 5.0 milliliters of sodium bicarbonate solution was also added to each beaker. The solutions were then stirred while raising the temperatures of the solutions to 85° F. The desired amount of detergent was then added to each beaker and stirred until the detergent dissolved in the solution. The stirrer was then turned off and an initial reading at 85° F. was recorded. After the initial reading was recorded, the stirrer was turned back on and the temperature was then raised to 140° F. An initial reading and a 30-minute reading was recorded after the stirrer was turned off.

The readings are rated based upon the percent transmittance of the solution. The higher the transmittance percentage, the more clear the solution. A solution having a rating above 85% is considered as being very good at preventing hard water precipitation.

Stain Removal Test

Various swatches were soiled to determine the efficacy of alkyl vinyl vinyl ether-maleic acid copolymer in removing soils from the swatches. The soils used included: lipstick, make-up, motor oil, soot on mineral oil, soot on olive oil, pigment on sebum, and pigment on lanolin. The soils were deposited on polycotton (mixture of polyester and cotton) swatches as well as cotton swatches.

Prior to laundering, the level of soiling of each of the swatches was observed and recorded. Three backers (swatches adjacent sewn together on a napkin) were used per load per detergent blend. Three backers containing the same kind of swatches were then evenly distributed per load. Approximately 25 pounds of polyester and cotton fabric were added to the cycle. The laundry was operated with a water temperature of approximately 140° Fahrenheit (° F). The detergent was then added into the cycle. Approximately 185 grams of a solution of a detergent containing methyl vinyl ether-maleic acid copolymer was also added to the cycle.

The same procedure was followed for the original formulation of the detergent. Approximately 200 grams of the known detergent was added to the cycle.

After laundering, the level of soil remaining on the swatches was compared to the level of soil prior to laundering. The percent of soil removal was calculated and recorded.

Materials Used

- Gantrez S-95: a methyl vinyl ether-maleic acid copolymer having a molecular weight of approximately 216,000 Daltons, available from International Specialty Products, Wayne, N.J.
- Gantrez S-96: a methyl vinyl ether-maleic acid copolymer having a molecular weight of approximately 600,000 Daltons, available from International Specialty Products, Wayne, N.J.
- EVD 65753: a methyl vinyl ether-maleic acid copolymer having a molecular weight of approximately 100,000 Daltons, available from BASF Corporation, Florham Park, N.J.
- EVD 65754: a methyl vinyl ether-maleic acid copolymer having a molecular weight of approximately 1,000,000 Daltons, available from BASF Corporation, Florham Park, N.J.

Example 1 and Comparative Example A

Example 1 and Comparative Example 1 compare the effectiveness of a base detergent composition containing methyl vinyl ether-maleic acid copolymer with the effectiveness of the same base detergent composition containing triphosphono methyl amine, hydroxyethylidene diphosphonic acid, trisodium hydroxyethyl ethylenediamine triacetic acid (HEDTA) liquid, and nitrilo-triacetic acid (NTA) $Na_3.H_20$. The composition of Example 1 and the composition of Comparative Example A both contained base Detergent X at a 1% solution. The only difference between the compositions of Example 1 and Comparative Example 2 was that the composition of Example 1 contained 25% by weight (12% active) Gantrez S-96 and balance water, while the composition of Comparative Example A contained 1.5% by weight triphosphono methyl amine at 50%, 0.55% by weight hydroxyethylidene disphosphonic acid at 60%, 1% by weight trisodium HEDTA liquid at 38%, and 9% by weight (NTA) $Na_3.H_20$.

The components of Example 1 were mixed together for approximately 10 minutes to thoroughly dissolve all of the components. The components of Comparative Example A were also mixed together for approximately 10 minutes to thoroughly dissolve all of the components.

The compositions of Example 1 and Comparative Example A were then subjected to the chelation test, as discussed above, to observe precipitation and percent transmittance of the compositions at various temperatures. The results are tabulated below in Table 1.

TABLE 1

| Water Hardness, grain | Example 1 Transmittance, % | | |
|---|---|---|---|
| per gallon (gpg) | 85° F. | 140° F. | 160° F. |
| 12 | 97.8 | 98.4 | 98.6 |
| 14 | 96.4 | 96.2 | 96.0 |
| 16 | 97.2 | 96.6 | 96.8 |
| 18 | 97.4 | 96.6 | 96.8 |
| 20 | 97.2 | 95.6 | 95.2 |
| 22 | 96.8 | 94.8 | 93.0 |
| 36 | 50.4 | 24.0 | 13.4 |
| 38 | 23.8 | 6.8 | 4.0 |
| | Comparative Example A Transmittance, % | | |
| Water Hardness, gpg | 85° F. | 140° F. | 160° F. |
| 12 | 100.00 | 100.00 | 99.8 |
| 14 | 100.00 | 100.00 | 99.8 |
| 16 | 99.8 | 100.00 | 99.6 |
| 18 | 100.00 | 100.00 | 99.4 |
| 20 | 100.00 | 100.00 | 99.6 |
| 22 | 99.6 | 99.6 | 99.6 |
| 36 | 99.4 | 98.6 | 98.0 |
| 38 | 98.6 | 86.8 | 73.2 |

The compositions of Example 1 and Comparative Example A were first tested for precipitation and percent transmittance, which is illustrated by the data provided in Table 1. As can be seen in Table 1, the compositions of Example 1 and Comparative Example A exhibited comparable transmittance percentages up to approximately 22 grains per gallon (gpg) at 85° F., 140° F., and 160° F. Precipitation occurred at approximately 36 gpg for Example 1 at all three temperature ranges, while precipitation did not occur for Comparative Example A until approximately 38 gpg at 160° F. For the composition of Example 1, the percent transmittance was affected by the amount of methyl vinyl ether-maleic acid copolymer available to react with calcium in the solution. For the composition of Comparative Example A, the percent transmittance was affected by the amount of triphosphono methyl amine, hydroxyethylidene diphosphonic acid 60%, trisodium hydroxyethyl ethylenediamine triacetic acid (HEDTA) liquid 38%, and nitrilo-triacetic acid (NTA) $Na_3$-$H_20$.

After the chelation test, the compositions of Example 1 and Comparative Example A were tested to determine the amount of various soils the compositions removed from various swatches. Table 2 provides the average percent of soil removed from the swatches using the compositions of Example 1 and Comparative Example A.

TABLE 2

| Soil | Example 1, wt % | Comparative Example A, wt % |
|---|---|---|
| Lipstick on cotton | 51.46 | 45.99 |
| Make-up on cotton | 48.49 | 50.40 |
| Motor Oil on polycotton | 18.20 | 19.08 |
| Lanolin on cotton | 42.84 | 47.92 |
| Soot on Olive Oil on polycotton | 29.15 | 33.48 |
| Soot on Olive Oil on cotton | 26.45 | 33.45 |
| Soot on Mineral oil on polycotton | 21.35 | 22.10 |
| Soot on Mineral oil on cotton | 16.68 | 16.88 |
| Sebum on polycotton | 34.67 | 38.42 |
| Sebum on cotton | 62.29 | 63.47 |
| Average | 35.16 | 37.12 |

As can be seen in Table 2, the amount of soil removed using the compositions of Example 1 and Comparative Example A were very similar. In particular, the average percentage of soil removed using the composition of Example 1 was 35.16% and the average percentage of soil removed using the composition of Comparative Example A was 37.12%, a difference of less than 2%. The ability of the composition of Example 1 to remove soil is thus comparable with the ability of the composition of Comparative Example A, to remove soil. The results of Table 2 show that Gantrez S-96 is an effective replacement for triphosphono methyl amine, hydroxyethylidene diphosphonic acid 60%, trisodium hydroxyethyl ethylenediamine triacetic acid (HEDTA) liquid 38%, and nitrilo-triacetic acid (NTA) $Na_3$-$H_20$.

Example 2 and Comparative Example B

Example 2 and Comparative Example B compared the effectiveness of a base detergent composition containing a methyl vinyl ether-maleic copolymer with the effectiveness of the same base detergent composition containing triphosphono methyl amine, hydroxyethylidene diphosphonic acid, trisodium hydroxyethyl ethylenediamine triacetic acid (HEDTA) liquid, and nitrilo-triacetic acid (NTA) $Na_3$-$H_20$. Both the compositions of Example 2 and Comparative Example B contained base Detergent X at a 1% solution. The composition of Example 2 had a pH of 11.85 and the composition of Comparative Example B had a pH of 11.48. The compositions of Example 2 and Comparative Example B were the same except that Example 2 contained 3% by weight Gantrez S-95 and balance water while the composition of Comparative Example B contained 1.5% by weight triphosphono methyl amine at 50%, 0.55% by weight hydroxyethylidene disphosphonic acid at 60%, 1% by weight trisodium HEDTA liquid at 38%, and 9% by weight trisodium NTA.$H_2O$.

The components of Example 2 were mixed together for approximately 10 minutes to thoroughly dissolve all of the components. The components of Comparative Example B were also mixed together for approximately 10 minutes to thoroughly dissolve all of the components.

The compositions of Example 2 and Comparative Example B were then subjected to the chelation test, as discussed above, to observe precipitation and percent transmittance of the compositions at 85° F., 140° F., and 160° F. The results are tabulated below in Table 3.

TABLE 3

| Water Hardness, grain per gallon (gpg) | Example 2 Transmittance, % 85° F. | 140° F. | 160° F. |
|---|---|---|---|
| 12 | 96.6 | 96.00 | 96.40 |
| 14 | 94.4 | 93.8 | 93.4 |
| 16 | 95.2 | 93.40 | 93.60 |
| 18 | 91.20 | 87.80 | 87.60 |
| 20 | 88.40 | 90.00 | 89.60 |
| 22 | 89.20 | 84.20 | 81.20 |
| 36 | 34.60 | 16.80 | 9.60 |
| 38 | 40.20 | 16.00 | 8.80 |
| 40 | 28.20 | 5.00 | 3.20 |

| Water Hardness, gpg | Comparative Example B Transmittance, % 85° F. | 140° F. | 160° F. |
|---|---|---|---|
| 18 | 100.00 | 100.00 | 98.8 |
| 20 | 100.00 | 100.00 | 98.8 |
| 22 | 99.6 | 99.6 | 99.6 |
| 24 | 99.6 | 99.4 | 98.8 |
| 26 | 99.8 | 99.4 | 99.4 |
| 28 | 99.0 | 98.8 | 98.8 |
| 30 | 98.8 | 98.6 | 98.6 |
| 32 | 99.2 | 99.2 | 98.8 |
| 34 | 99.4 | 98.4 | 97.6 |
| 36 | 99.4 | 98.6 | 98.0 |
| 38 | 98.6 | 86.8 | 73.2 |

As can be seen in Table 3, the compositions of Example 2 and Comparative Example B exhibited varying transmittance percentages. Precipitation occurred at approximately 36 gpg for Example 2 at 85° F., 140° F., and 160° F. Comparative Example B did not exhibit precipitation up to approximately 38 gpg at all three temperature ranges. It is believed that the precipitation of calcium carbonate in the composition of Example 2 occurred at a lower grain per gallon than the composition of Comparative Example B because the composition of Example 2 did not contain enough Gantrez S-95, and therefore could not prevent the precipitation of calcium carbonate.

The compositions of Example 2 and Comparative Example B were then tested to determine the amount of soil removed from various swatches under different test conditions than Example 1 and Comparative Example A. Various soils were deposited on polycotton and cotton swatches. The compositions of Example 2 and Comparative Example B were then used to remove the soil from the swatches. Table 4 provides the average percent of soil removed using the compositions of Example 2 and Comparative Example B.

TABLE 4

| Soil | Example 2, % soil removal | Comparative Example B, % soil removal |
|---|---|---|
| Lipstick on cotton | 48.88 | 40.32 |
| Make-up on polycotton | 34.01 | 17.16 |
| Make-up on cotton | 17.84 | 15.69 |
| Used motor oil on polycotton | 14.93 | 14.86 |
| Used motor oil on cotton | 20.94 | 20.62 |
| Soot/mineral oil on polycotton | 21.52 | 14.51 |
| Soot/mineral oil on cotton | 14.50 | 10.38 |
| Soot/olive oil on polycotton | 13.44 | 13.24 |
| Soot/olive oil on cotton | 15.88 | 18.48 |
| Pigment/sebum on polycotton | 12.04 | 12.89 |
| Pigment/sebum on cotton | 21.30 | 25.30 |
| Pigment/lanolin on polycotton | 14.35 | 9.67 |
| Pigment/lanolin on cotton | 35.23 | 25.68 |
| Average Soil removal | 21.91 | 18.37 |

As can be seen in Table 4, the amount of soil removed using the composition of Example 2 was greater than the amount of soil removed using the composition of Comparative Example B. In particular, the average percentage of soil removed using the composition of Example 2 was 21.91%, while and the average percentage of soil removed using the composition of Comparative Example B was 18.37%. In addition, the composition of Example 2 removed a greater percent of soil than the composition of Comparative Example B in all categories of soils and swatch materials. The ability of the composition of Example 2 to remove soil is thus greater than the ability of the composition of Comparative Example B to remove soil. The results of Table 4 show that Gantrez S-95 is an effective replacement for triphosphono methyl amine, hydroxyethylidene diphosphonic acid 60%, trisodium hydroxyethyl ethylenediamine triacetic acid (HEDTA) liquid 38%, and nitrilotriacetic acid (NTA) $Na_3$-$H_20$.

Example 3 and Comparative Example C

Example 3 and Comparative Example C compared the effectiveness of a base detergent composition containing a methyl vinyl ether-maleic copolymer with the effectiveness of the same base detergent composition containing tetrasodium ethylenediamine triacetic acid (EDTA). The compositions of Example 3 and Comparative Example C both included base Detergent Y at a 0.1% solution. The composition of Example 3 had a pH of 10.87 at a 10% weight solution. The composition of Comparative Example C had a pH of 10.72 at a 10% weight solution. The composition of Example 3 and the composition of Comparative Example C were the same except that Example 3 contained 2.6% by weight Gantrez S-95 and balance water, while the composition of Comparative Example C contained 17% by weight tetrasodium EDTA.

The components of Example 3 were mixed together for approximately 10 minutes to thoroughly dissolve all of the components. The components of Comparative Example C were also mixed together for approximately 10 minutes to thoroughly dissolve all of the components.

The compositions of Example 3 and Comparative Example C were then subjected to the chelation test, as discussed above, to observe precipitation and percent transmittance of the compositions at various temperatures. The results are tabulated below in Table 5.

TABLE 5

| Water Hardness, grain per gallon (gpg) | Example 3 Transmittance, % 85° F. | 140° F. | 160° F. |
|---|---|---|---|
| 10 | 99.6 | 75.8 | 55.0 |
| 12 | 99.6 | 71.6 | 55.2 |
| 14 | 99.4 | 71.6 | 55.2 |
| 16 | 99.4 | 70.6 | 55.0 |
| 18 | 99.4 | 70.8 | 53.2 |
| 20 | 99.4 | 70.4 | 53.8 |
| 22 | 99.2 | 70.2 | 53.0 |
| 24 | 99.0 | 70.2 | 52.8 |
| 26 | 99.0 | 70.2 | 47.0 |

| Water Hardness, gpg | Comparative Example C Transmittance, % 85° F. | 140° F. | 160° F. |
|---|---|---|---|
| 10 | 99.0 | 70.8 | 51.0 |
| 12 | 98.8 | 64.0 | 51.2 |
| 14 | 98.8 | 64.0 | 50.8 |
| 16 | 99.0 | 62.2 | 51.0 |
| 18 | 99.0 | 61.4 | 48.6 |
| 20 | 99.0 | 61.6 | 46.8 |
| 22 | 99.0 | 57.6 | 46.0 |
| 24 | 99.0 | 58.0 | 46.4 |
| 26 | 99.0 | 58.6 | 47.2 |

Example 3 and Comparative Example C were first tested for precipitation and percent transmittance, which are illustrated by the data provided in Table 5. As can be seen in Table 5, at 85° F. the compositions of Example 3 and Comparative Example C exhibited comparable transmittance percentages up to approximately 26 grains per gallon (gpg). At the higher temperatures of 140° F and 160° F., the composition of Example 3 exhibited greater transmittance percentages from 10 gpg to 26 gpg than the composition of Comparative Example C. The composition of Example 3 thus exhibited better water conditioning results, showing that Gantrez S-95 is an effective replacement for tetrasodium EDTA.

After the compositions were tested for precipitation and percent transmittance, the compositions of Example 3 and Comparative Example C were then tested to determine the amount of various soils removed from polycotton and cotton. Table 6 provides the average percent of soil removed using the compositions of Example 3 and Comparative Example C.

TABLE 6

| Soil | Example 3, % soil removal | Comparative Example C, % soil removal |
|---|---|---|
| Lipstick on cotton | 45.47 | 39.37 |
| Make-up on polycotton | 37.84 | 32.52 |
| Make-up on cotton | 16.57 | 15.48 |
| Used motor oil on polycotton | 16.76 | 17.23 |
| Used motor oil on cotton | 25.21 | 20.97 |
| Soot/mineral oil on polycotton | 35.12 | 34.10 |
| Soot/mineral oil on cotton | 21.04 | 21.23 |
| Soot/olive oil on polycotton | 24.13 | 22.14 |
| Soot/olive oil on cotton | 27.41 | 26.36 |
| Pigment/sebum on polycotton | 16.39 | 14.36 |
| Pigment/sebum on cotton | 28.96 | 27.47 |
| Pigment/lanolin on polycotton | 9.65 | 10.32 |
| Pigment/lanolin on cotton | 38.49 | 35.79 |
| Average Soil removal | 26.39 | 24.41 |

As illustrated in Table 6, the amount of soil removed using the composition of Example 3 was greater than the amount of soil removed using the composition of Comparative Example C. In particular, the average percentage of soil removed using the composition of Example 3 was 26.39%, while and the average percentage of soil removed using the composition of Comparative Example C was 24.41%. In addition, the composition of Example 3 removed a greater percent of soil than the composition of Comparative Example C in all but two categories: motor oil on polycotton and pigment on lanolin oil on polycotton. Even in these two categories, the difference in the percent of soil removed was less than 1%. Overall, the ability of the composition of Example 3 to remove soil is thus greater than the ability of the composition of Comparative Example C to remove soil. The results of Table 6 show that Gantrez S-95 is an effective replacement for EDTA.

Examples 4, 5, and 6 and Comparative Example D

Examples 4, 5, and 6 and Comparative Example D compared the effectiveness of a base detergent composition containing a methyl vinyl ether-maleic acid copolymer with the same base detergent composition containing low density anhydrous sodium tripolyphosphate and anhydrous sodium tripolyphosphate powder. All of Examples 4, 5, and 6 and Comparative Example D contained base Detergent Z at 0.1% solution. The composition of Example 4 contained 2.6% by weight Gantrez S-95 and balance water and had a pH of 11.87 at a 10% weight solution. The composition of Example 5 contained 2.6% by weight EVD 65754 and balance water at 0.1% solution based on 100% free acid and had a pH of 11.43. The composition of Example 6 contained 2.6% by weight EVD 65753 and balance water at 0.1% solution based on 100% free acid and had a pH of 11.6. The composition of Comparative Example D had a pH of 11.6 and was the same as the compositions of Examples 4-6 except that the methyl vinyl ether-maleic acid copolymer was replaced with 26.25% by weight low density anhydrous sodium tripolyphosphate and anhydrous sodium tripolyphosphate powder.

The components of each of Example 4, Example 5, Example 6, and Comparative Example D, respectively, were mixed together for approximately 10 minutes to thoroughly dissolve all of the components.

The compositions of Example 4, Example 5, Example 6, and Comparative Example D were then subjected to the chelation test, as discussed above, to observe precipitation and percent transmittance of the compositions at various temperatures. The results are tabulated below in Table 7.

TABLE 7

| Water Hardness, grain per gallon (gpg) | Example 4 Transmittance, % 85° F. | 140° F. | 160° F. |
|---|---|---|---|
| 10 | 99.2 | 80.0 | 58.6 |
| 12 | 99.0 | 76.0 | 58.4 |
| 14 | 99.0 | 76.0 | 58.6 |
| 16 | 98.0 | 76.2 | 57.2 |
| 18 | 98.0 | 75.4 | 53.4 |
| 20 | 98.2 | 74.0 | 54.8 |
| 22 | 98.0 | 74.6 | 51.6 |

TABLE 7-continued

| Water Hardness, gpg | 85° F. | 140° F. | 160° F. |
|---|---|---|---|
| | Example 5 Transmittance, % | | |
| 10 | 99.6 | 80.2 | 56.8 |
| 12 | 99.2 | 83.2 | 69.4 |
| 14 | 98.4 | 92.8 | 58.8 |
| 16 | 96.4 | 94.2 | 73.2 |
| 18 | 98 | 98.8 | 76 |
| 20 | 99.8 | 97.6 | 81.8 |
| 22 | 99.6 | 97 | 57 |
| | Example 6 Transmittance, % | | |
| 10 | 98.4 | 98 | 59.2 |
| 12 | 98.6 | 97.6 | 56.4 |
| 14 | 98.2 | 98.2 | 58.8 |
| 16 | 97.6 | 97.6 | 61.8 |
| 18 | 97.6 | 97.8 | 57.4 |
| 20 | 96.8 | 97.2 | 76 |
| 22 | 95.8 | 95.6 | 56.8 |
| 24 | 95.8 | 95.2 | 69.4 |
| | Comparative Example D Transmittance, % | | |
| 10 | 99.4 | 69.8 | 50.2 |
| 12 | 99.2 | 69.6 | 50.6 |
| 14 | 99.2 | 66.0 | 50.4 |
| 16 | 99.2 | 64.6 | 50.0 |
| 18 | 99.2 | 65.0 | Flock |
| 20 | 99.2 | 60.2 | Flock |

As can be seen in Table 7, the compositions of Example 4, Example 5, Example 6, and Comparative Example D exhibited comparable transmittance percentages up to approximately 20 grains per gallon (gpg) at 85° F. At 140° F. and 160° F., the compositions of Example 4, Example 5, and Example 6 exhibited greater transmittance percentages from 10 gpg to 26 gpg than the composition of Comparative Example D. The results recorded in Table 7 thus show that methyl vinyl ether-maleic acid copolymer present in the compositions of Example 4, Example 5, and Example 6 is an effective replacement for low density anhydrous sodium tripolyphosphate and anhydrous sodium tripolyphosphate powder in terms of water conditioning.

The compositions of Example 4, Example 5, Example 6, and Comparative Example D were then tested to determine the amount of soil the compositions were capable of removing. Table 8 provides the average percent of various soils removed from swatches formed of polycotton and cotton using the compositions of Example 4, Example 5, Example 6, and Comparative Example D.

TABLE 8

| Soil | Example 4, wt % | Example 5, wt % | Example 6, wt % | Comparative Example D, wt % |
|---|---|---|---|---|
| Make-up on cotton | 48.15 | 51.34 | 51.02 | 42.26 |
| Motor Oil on polycotton | 20.70 | 19.38 | 18.21 | 21.80 |
| Lanolin on cotton | 55.01 | 42.42 | 43.41 | 52.45 |
| Soot on Olive Oil on polycotton | 28.67 | 32.90 | 31.85 | 30.49 |
| Soot on Olive Oil on cotton | 29.70 | 27.32 | 28.65 | 42.13 |
| Soot on Mineral oil on polycotton | 13.18 | 21.90 | 21.05 | 15.65 |

TABLE 8-continued

| Soil | Example 4, wt % | Example 5, wt % | Example 6, wt % | Comparative Example D, wt % |
|---|---|---|---|---|
| Soot on Mineral oil on cotton | 21.20 | 22.42 | 16.36 | 19.63 |
| Sebum on polycotton | 36.19 | 38.57 | 34.60 | 21.73 |
| Sebum on cotton | 66.86 | 64.90 | 62.40 | 61.19 |
| Average | 35.52 | 37.48 | 35.98 | 34.15 |

As illustrated in Table 8, the amount of soil removed using the compositions of Examples 4-6 were higher than the amount of soil removed using the composition of Comparative Example D. In particular, the average percentage of soil removed using the composition of Example 4 was 35.52%, the average percentage of soil removed using the composition of Example 5 was 37.48%, and the average percentage of soil removed using the composition of Example 6 was 35.98%, while and the average percentage of soil removed using the composition of Comparative Example D was 34.15%. It is believed that increasing the amount of methyl vinyl ether-maleic acid copolymer may increase the amount of soil removed. The results of Table 6 show that methyl vinyl ether-maleic acid copolymer, in the form of Gantrez S-95, EVD 65754, and EVD 65753, is an effective replacement for the low density anhydrous sodium tripolyphosphate and anhydrous sodium tripolyphosphate powder.

The methyl vinyl ether-maleic acid copolymer present in the cleaning composition of the present invention exhibits the ability to prevent the precipitation of calcium carbonate and the ability to remove soils from the surface of textiles. It is believed that the methyl vinyl ether-maleic acid copolymer functions as a crystal modifier to prevent crystal growth. By binding to calcium ions, the methyl vinyl ether-maleic acid copolymer prevents the crystals of calcium carbonate from growing and precipitating into solution and attaching to the surface of textiles. It is also believed that the hydrophobic nature of the methyl vinyl ether-maleic acid copolymer and the presence of carboxylate groups allow the copolymer to aid in removing soils attached to a surface, which may be a fabric or a hard surface.

Although the present invention has been described with reference to preferred embodiments, workers skilled in the art will recognize that changes may be made in form and detail without departing from the spirit and scope of the invention.

The invention claimed is:

1. A method of removing soils from a textile surface and preventing calcium precipitation from the textile surface, the method comprising:

(a) forming a use solution having a pH of between 10 and 12 consisting of an alkyl vinyl ether-maleic acid copolymer, water, and at least one component selected from the group consisting of: sodium carbonate and sodium hydroxide, phosphates, phosphonates, phosphites and aminocarboxylates, wherein the use solution has less than about 100 parts per million phosphates, phosphonates, phosphites and aminocarboxylates;

(b) applying the use solution onto the textile surface for an amount of time sufficient to remove soils from the textile surface and to prevent calcium precipitation onto the textile surface;

(c) washing the textile surface in the use solution; and (d) rinsing the use solution from the textile surface.

2. The method of claim 1, wherein the use solution has less than about 10 parts per million of the phosphates, phosphonates, phosphites, and aminocarboxylates.

3. The method of claim 1, wherein the use solution has less than about 1 parts per million of the phosphates, phosphonates, phosphites, and aminocarboxylates.

4. The method of claim 1, wherein the use solution has between 5 parts per million and 200 parts per million of the alkyl vinyl ether-maleic acid copolymer.

5. The method of claim 1, wherein the use solution has between 10 parts per million and 50 parts per million of the alkyl vinyl ether-maleic acid copolymer.

6. The method of claim 1, wherein the copolymer is methyl vinyl ether-maleic acid copolymer.

7. The method of claim 1, wherein the use solution has a pH of between 10.5 and 12.

* * * * *